US011111741B2

(12) United States Patent
Confield

(10) Patent No.: US 11,111,741 B2
(45) Date of Patent: Sep. 7, 2021

(54) MUD FILTER

(71) Applicant: Paul Terence Confield, Abu Dhabi (AE)

(72) Inventor: Paul Terence Confield, Abu Dhabi (AE)

(73) Assignee: Wellbore Debris Solutions FZ LLC, Fujairah (AE)

( * ) Notice: Subject to any disclaimer, the term of this patent is extended or adjusted under 35 U.S.C. 154(b) by 0 days.

(21) Appl. No.: 16/630,627

(22) PCT Filed: Jul. 3, 2018

(86) PCT No.: PCT/EP2018/067975
§ 371 (c)(1),
(2) Date: Jan. 13, 2020

(87) PCT Pub. No.: WO2019/068378
PCT Pub. Date: Apr. 11, 2019

(65) Prior Publication Data

US 2021/0148178 A1 May 20, 2021

Related U.S. Application Data

(60) Provisional application No. 62/566,600, filed on Oct. 2, 2017.

(51) Int. Cl.
*E21B 21/00* (2006.01)
*E21B 27/00* (2006.01)

(52) U.S. Cl.
CPC ..... *E21B 21/00* (2013.01); *E21B 27/00* (2013.01)

(58) Field of Classification Search
CPC ..... E21B 11/04; E21B 31/08; E21B 21/00; E21B 27/00
See application file for complete search history.

(56) References Cited

U.S. PATENT DOCUMENTS

2011/0024119 A1* 2/2011 Wolf ..... E21B 37/00 166/301
2012/0118571 A1* 5/2012 Zhou ..... E21B 27/00 166/301

(Continued)

FOREIGN PATENT DOCUMENTS

GB 2 468 972 A 9/2010
WO 2014/047403 A1 3/2014
WO 2016/168259 A1 10/2016

OTHER PUBLICATIONS

International Search Report for PCT/EP2018/067975 dated Nov. 20, 2018 [PCT/ISA/210].

(Continued)

*Primary Examiner* — Kristyn A Hall
(74) *Attorney, Agent, or Firm* — Sughrue Mion, PLLC

(57) ABSTRACT

A downhole mud filter (100) comprising a tubular member (1) connectable to the drill string used to prevent debris-laden fluid from entering sensitive BHA tools and components further downhole relative to the mud filter. A tubular member having a sub assembly consisting of a bristle rings (6) and/or rupture (7) to intentionally create a restriction and divert debris-laden fluid around a cylindrical mesh (2) and/or screen surrounded by permanent magnets (3). The openings (9) on the mesh and/or screen allow fluid to pass through while preventing particulates or debris from entering and retaining such debris on the outside of the screen and/or mesh. Magnets (3) arranged around the outer diameter of the screen and/or mesh (2) and along its length captures and retains smaller ferrous debris which the screen and/or mesh cannot filter.

15 Claims, 4 Drawing Sheets

(56) References Cited

U.S. PATENT DOCUMENTS

| | | | | |
|---|---|---|---|---|
| 2012/0175111 | A1 | 7/2012 | Mashburn et al. | |
| 2015/0226036 | A1* | 8/2015 | Wolf | E21B 31/00 166/311 |

OTHER PUBLICATIONS

Written Opinion for PCT/EP2018/067975 dated Nov. 20, 2018 [PCT/ISA/237].

* cited by examiner

MUD FILTER

FIELD OF THE INVENTION

The present invention relates to a tool used for capturing and removing residual debris from drilling fluid typically found in the wellbore in oil and gas drilling operations. More particularly, the invention relates to a downhole tool mounted on a drill string incorporating capture and retaining methods to prevent debris-laden fluid from entering sensitive BHA (Bottom Hole Assembly) tools and components.

BACKGROUND

Over the past 20 years, the oil and gas industry has been drilling deeper and more horizontal wells to maximize the production from each well. This in turn has increased the amount of metallic filings and debris in the well due to casing wear. Casing wear is a result of rotating the drill string or workstring inside the production casing for extended periods of time. The metallic fines suspended in the drilling fluid system being pumped down the drill string can pose problems for sensitive BHA (Bottom Hole Assembly) equipment components such as Rotary Steerable Systems and Mud Motors. These components are susceptible to internal damage from fluid borne micronized metallic/magnetized debris MWD/LWD survey tools can be adversely affected by magnetized debris in the drilling fluid, inducing Survey errors.

Drilling fluid used in oil and gas well drilling is typically circulated on a closed-loop system from one active pit. The fluid is pumped down the hollow drill string to the drill bit from the surface before returning. The purpose of the drilling fluid is to provide hydrostatic pressure to control formation pressure, carry drill cuttings to surface, powers mud motors, cools and lubricates the drill bit as well as providing well stability.

Typically there are tools used in the oil and gas industry that help minimize the level and remove debris the wellbore during such drilling operations, for example filtration subs. These tools contain a mandrel surrounded by a mesh-like or slotted screen where the debris-laden fluid in the wellbore can enter annular gap between the screen and mandrel but the mesh/slots capture and prevent debris from escaping back into the wellbore, therefore conditioning the fluid as it re-enters the wellbore. Various sizes of debris can be captured and retained depending on the size of the mesh/slots. Magnetic debris recovery tools are another example used during drilling operations to remove debris but more specifically remove ferrous or metallic debris. High strength magnets mounted along a tool body attracts any ferrous debris present in the drilling fluid in the wellbore. Capture areas on the tool retains the debris unfit the tool reaches the surface after drilling operations.

Both methods of capturing and retaining debris offer their own merits when it comes to removing debris from the drilling fluid in the annulus between the drill string and casing. This method is common when performing wellbore clean up operations. However, there are no guarantees that the fluid circulated to surface is free from debris before re-entering the drill string and passing through sensitive BHA tools.

Shale shakers and ditch magnets are equipment commonly found at the surface of an oil well. Their purpose is to remove solids from the fluid prior to returning down the drill string. Shale shakers are the primary method of removing solids from the drilling fluid. The fluid passes through a vibrating fine screen that catches the debris before being discarded. However, these screens remove large drill solids and cuttings and are not fine enough to capture the fine steel filings. Ditch magnets are simple and effective at capturing and removing the fine metallic particles that the shale shakers miss. However, these filings and debris are not effectively recovered from the fluid as they can be washed off ditch magnets and pass through shale shaker screens before returning into the wellbore.

An object of the present invention is to improve debris capture during drilling operations. More particularly, the invention aims to capture and remove any debris present in drilling fluid as it re-enters the drill string and towards debris sensitive-tools and components.

SUMMARY OF THE INVENTION

According to a first aspect of the invention, there is provided a downhole mud filtration tool used in a wellbore of an oil well connected to an elongate member, the mud filtration tool comprising:

a tubular body which is connectable to an elongate member wherein the elongate member can be a drill string or workstring, having a bore which houses a cylindrical screen and/or mesh having a wall defining a plurality of openings and an outer diameter smaller than the bore of the body providing a debris collection area;

a magnetic assembly can be optionally mounted around the outer diameter of the screen mesh to capture ferrous debris, the magnet assembly consisting of high strength permanent magnets housed in hollow stainless steel sections;

a burst/rupture disc can be optionally mounted in the bore of the screen/mesh and responds to changes in pressure as welt as force, wherein in the 'running in' configuration prevents drilling fluid from entering the bore of the tool and diverts it towards the outer capture area of the screen/mesh;

a protective bristle ring or set of positioned in the bore and optionally in front of the burst/rupture disc to protect from fluid and debris damage as well as assisting in providing a resistance and diverting the fluid away from the bore.

An elongate member can be the drill string or work string which is typically used in the nit and gas industry and lowered into the wellbore during drilling operations.

Optionally, the cylindrical screen and/or mesh comprises of varying sizes of plurality of openings to accommodate different debris tolerance and mud viscosities. Optionally the length of screen and/or mesh is as long as the tubular body to maximize the flow through area. This in turn will not restrict the drilling circulation rates. Optionally, the long screen/mesh size prevents washing out damage and maximizes debris collection capacity.

Optionally, the configuration of the openings is not limited to circular holes. The openings can be in the form of longitudinally extending openings or slots or a combination of both which can be created by conventional milling techniques, laser or water jet cutting.

Support members mounted either end of the cylindrical screen/mesh help maintain the annular gap between the outside of the screen/mesh and bore of the tubular body to allow an area for debris to collect. The support members preferably contain threaded ends to be selectively connectable to the screen/mesh.

The support member at the lower end of the screen/mesh, the downhole end, can be a conical funnel arrangement which has an outer diameter slightly smaller than the bore of the body. This ensures the screen/mesh is centralized as well as aiding debris removal once the tool has arrived at surface. The outer diameter tapers down to a smaller diameter. A matching profile on the tubular body prevents the screen/mesh from moving while connected to the drill string. Optionally, the wall thickness of the tapered profile is constant which produces an internal recess. When the screen/mesh is pulled out of the tubular body, the conical funnel simultaneously drags the debris ensuring the bore of the tubular body is free from debris. The bore of the conical funnel is the same size as the screen/mesh to allow clean fluid to pass through the tool and downhole.

The upper end of the screen/mesh comprises of a dart-like support member. Similar to the lower conical funnel, the outer diameter is slightly smaller than the bore of the tubular body to allow for centralization. The outer diameter tapers down to the same outer diameter as the screen/mesh. Longitudinal openings on the dart support member allow maximum fluid bypass while retaining its strength. The openings acts like ribs to provide strength. Optionally, the bore of the support dart allows the bristle ring and rupture disc to be housed.

Rupture discs are typically used to prevent over-pressuring and damage. Such discs can be made from steel, Inconel or rubber. Optionally, the rupture disc in the mud filter can be made from a rubber such as HNBR. This material possesses the required chemical and temperature resistance required for offshore environments. Optionally, the shape and arrangement of the disc prevents fragments to form once burst to ensure remains do not travel further downhole to pressure sensitive tools or components. Optionally, the burst disc can be activated by pressure increase or by a physical load. If the capacity of the collection area is exceeded, the rupture disc acts as an emergency bypass safety system to prevent blocking the drill string.

Optionally, a bristle ring or set of is mounted in front of the rupture disc to protect the rupture disc from damage. Optionally, the bristle ring can be mounted in the bore without a rupture discs. Optionally, more than one bristle ring can be mounted in the bore by stacking. The fluid flow through the drill string during normal operations can be up to 10 barrels per minute. At this rate the fluid, which can also contain debris, can burst the rupture disc prematurely. Optionally, the individual bristles can be made from a resilient material such as but not limited to nylon. Optionally, using a compound of plastic allows the bristles to be flexible but also resilient enough to prevent debris from passing through. Optionally, the bristles can be made from steel. This offers more resilience and can deflect and prevent larger debris from passing through. Optionally, the bristles can be a mix of both compounds to offer the best resistance. Coupled with the rupture disc the bristle ring, as well as preventing flow and debris entering through the bore of the tool, are positioned in such a way that they create a bottleneck and encourage the majority of the drilling fluid to pass through the annular side of the screen/mesh.

A sub-assembly of permanent magnet bars can be optionally mounted around the outer diameter of the screen/mesh. Optionally, permanent magnets discs or other shapes are housed inside a hollow section of stainless steel and encapsulated. The stainless steel hollow section protects the magnets from harsh well conditions. Optionally, the permanent magnets are rare earth magnets designed to withstand high temperatures. Optionally, the stainless steel hollow section profile is rectangular. Optionally the length of the hollow section can be the same as the length of the screen/mesh. Optionally, two or more rings have an inner diameter sized larger than the screen/mesh and a wall thickness smaller or same size as the steel hollow section. Preferably, the rings are secured at either end of the magnet bar assembly. Optionally, the magnet bar assemblies are equispaced around the rings. Optionally, the magnet bar assemblies are secured to the rings by welding or any other permanent means. Optionally, there is sufficient space between each magnet strip to maximize fluid bypass and prevent a pressure drop across the too.

BRIEF DESCRIPTION OF THE DRAWINGS

Embodiments of the present invention will now be described, by way of example only and not in any limitative sense, with reference to the accompanying drawings, in which.

DETAILED DESCRIPTION OF THE DRAWINGS

Figure 1:
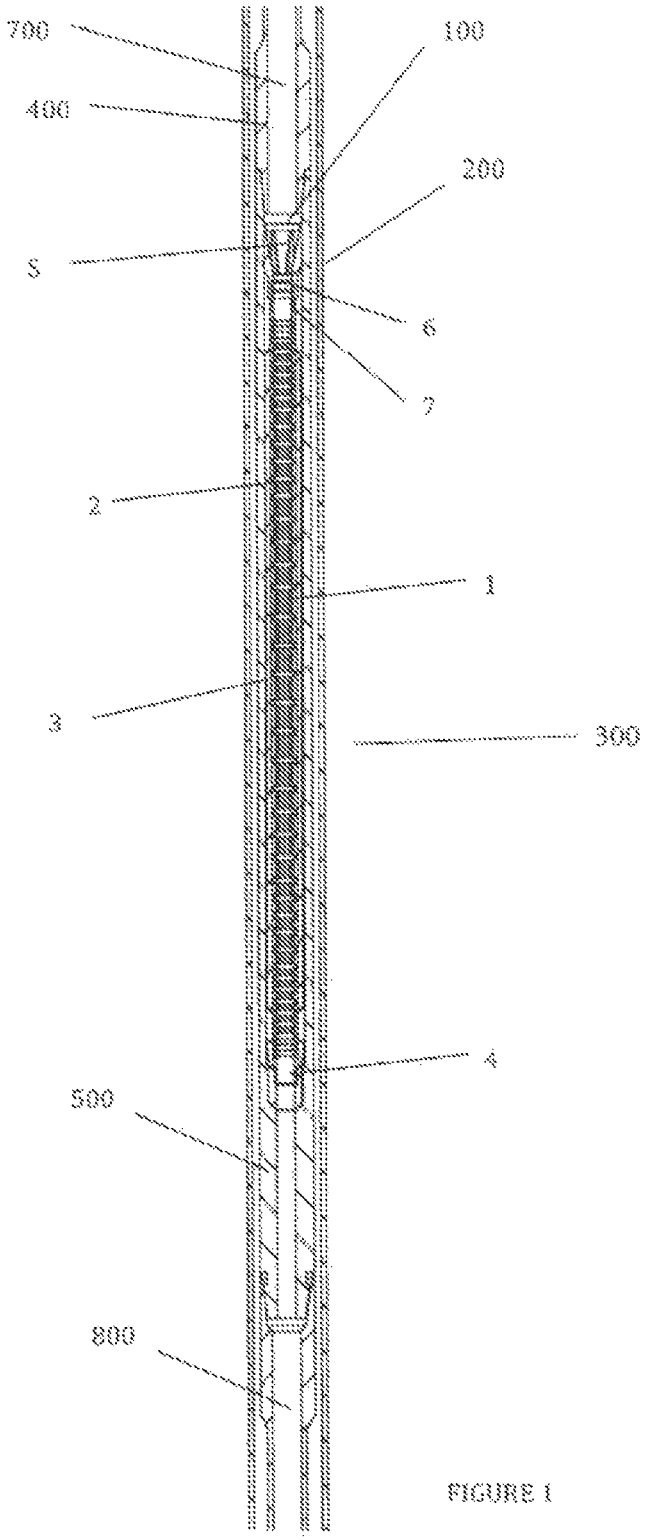
FIG. 1 is a schematic sectional view of the mud filter connected to elongate members at the upper and lower end of the tool and located inside the wellbore.

FIG. 1 is a schematic sectional view of the mud filter assembly 100, in accordance with an embodiment of an aspect of the present invention. The mud filter 100 is shown in a wellbore 200 and connected to a drill string with elongate members above 400 and below 500 the mud filter assembly 100. The debris-laden drilling fluid 700 is present in the upper bore of the drill string 300 prior to entering the mud filter 100. When the drilling fluid passes through the mud filter assembly 100, the drilling mud 800 below the drill string is free from debris.

The mugs filter 100 comprises a meta tubular body 1 and houses the cylindrical screen/mesh 2, magnets 3, shovel support member 4, centralizer support member 5, bristle ring 6 and rupture disc 7. As is common in the relevant industry, the tubular body 1 has threads on either end of the body. This allows the tubular body 1 to be selectively connectable to an elongate string (for example., a work string or drill string) and lowered downhole into a wellbore.

Figure 2:
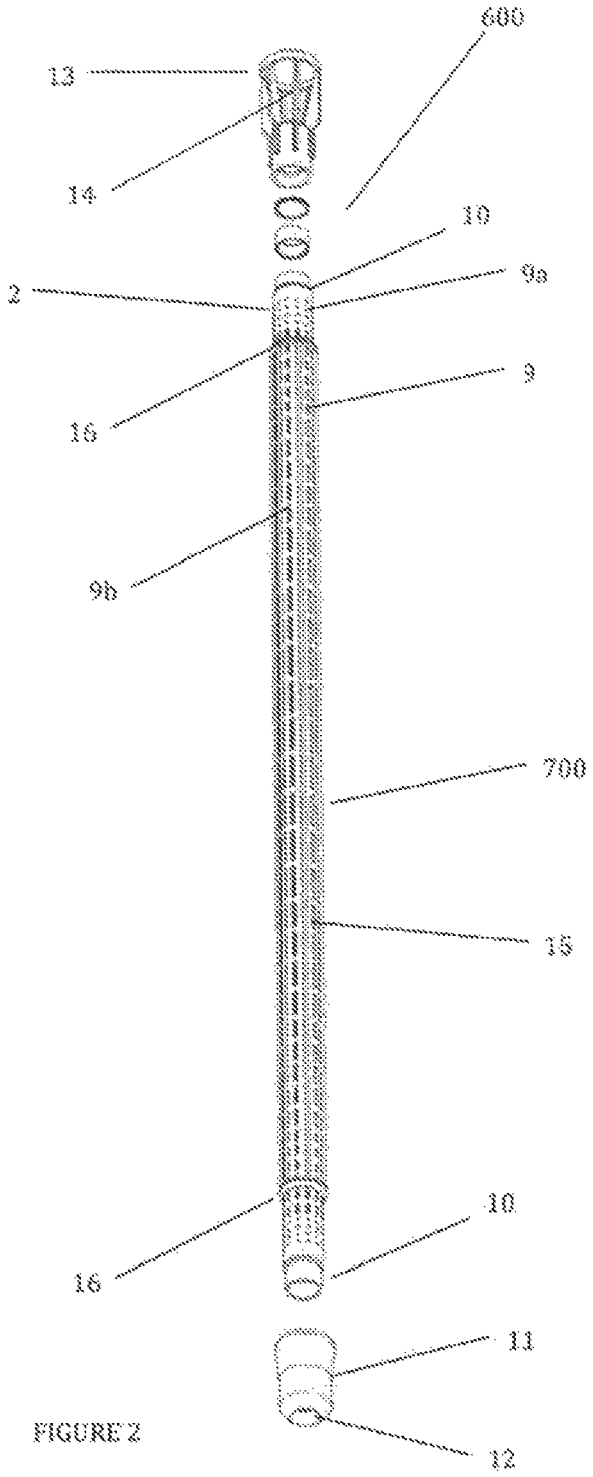
FIG. 2 is an exploded schematic view of the sub-assembly housed within the tubular body.
Figure 3:
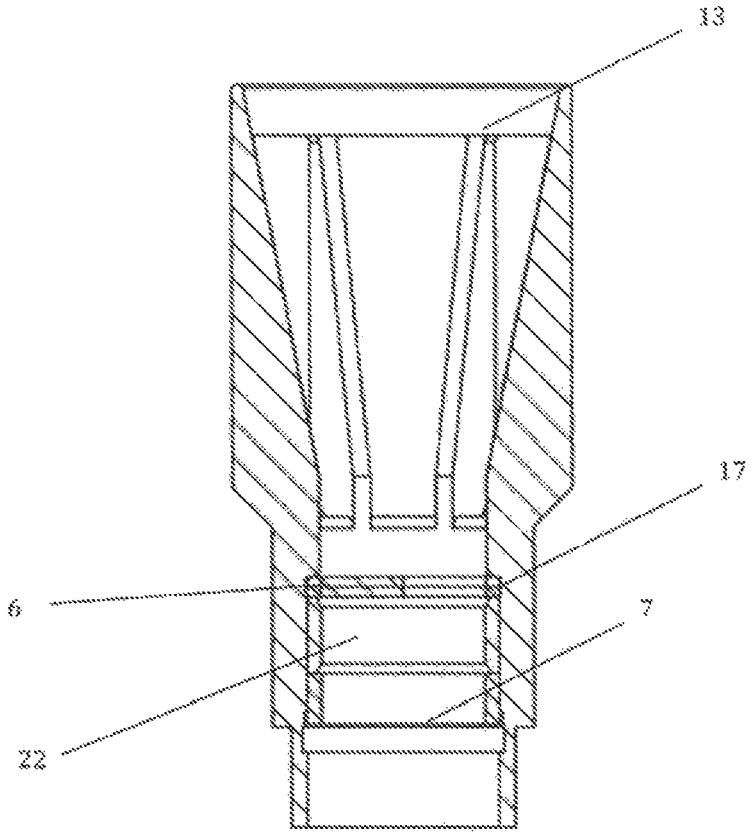
FIG. 3 is a schematic sectional view of the dart support member with the rupture disc and bristle ring assembled.
Figure 4:
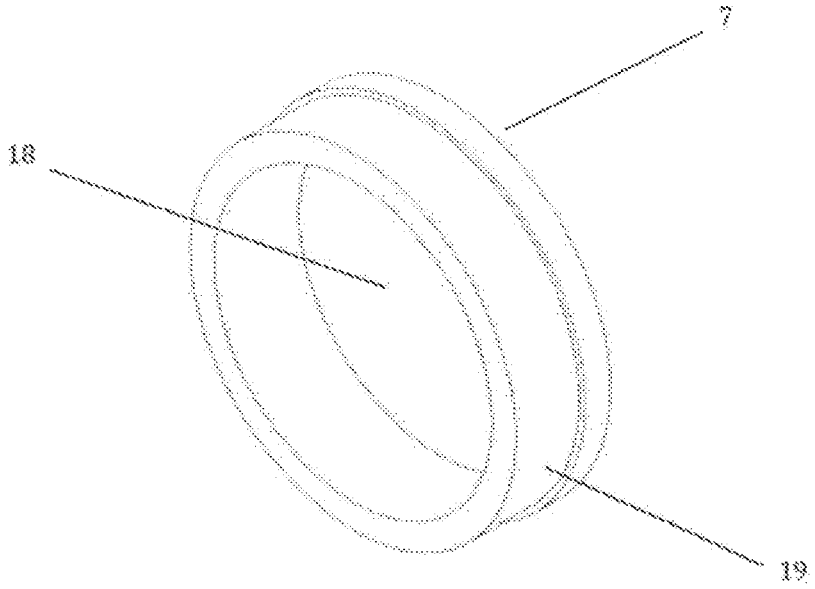
FIG. 4 is a schematic view of the rupture disc.
Figure 5:
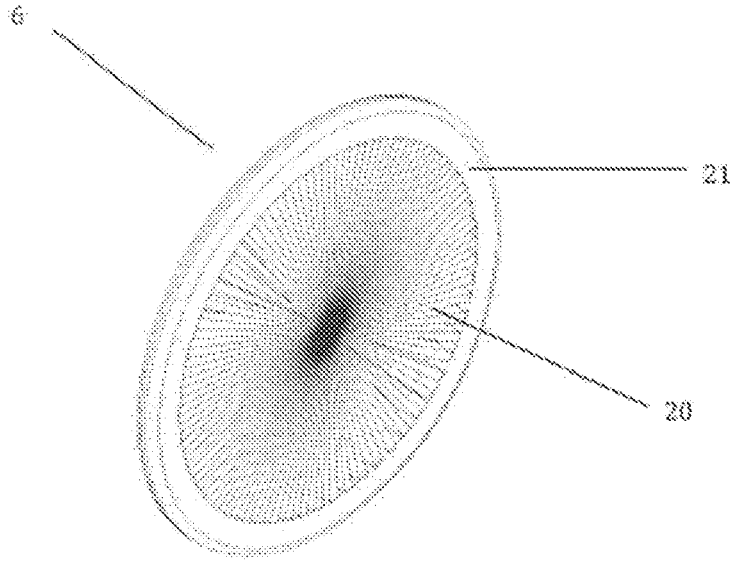
FIG. 5 is a schematic view of the bristle ring.

FIG. 2 shows a schematic view of the sub-assembly 600 housed within the tubular body 1. The screen/mesh 2 comprises a metal tubular in which a number of openings 9 have been cut These openings 9 can be but not limited to holes 9*a* and/or longitudinally-extending slots 9*b* or a combination of both. The arrangement may be sized as desired depending on the particular application to allow fluid flow through the screen/mesh 2 while filtering and retaining solids and debris within the annulus (described below). The screen/mash 2 can be constructed from a number of materials such as stainless steel, carbon steel or Inconel. Optionally, the screen/mesh 2 can be surface coated or treated to be able to withstand harsh chemicals as well as flow cutting associated with high flow rates, it is preferred that both ends of the screen/mesh 2 is threaded 10. In embodiment, the thread is a male external thread.

At the lower end of the sub-assembly 600, a conical funnel support member 11 is selectively connectable to the screen/mesh 2. In this embodiment, the conical funnel 11 comprises of a female internal thread and engages with the male external thread 10 of the screen/mesh 2. The conical funnel 11 has an internal bore 12 sized the same as the internal bore of the screen/mesh 2. The profile of the conical funnel 11 has an outer diameter slightly undersized from the bore of the tubular body. The funnel-like profile provides a scooping action when the sub-assembly 600 is removed from the tubular body when servicing. Additionally, the outer diameter provides support and centralizes the sub-assembly within the tubular body.

At the upper end of the sub-assembly 600, a dart support member 13 is selectively connectable to the screen/mesh 2 by mating threads 10. Similar to the conical funnel 11, the outer diameter is slightly undersized from the bore of the tubular body to provide support and centralizes the screen/mesh 2. The minor diameter is sized the same as the outer diameter of the screen/mesh 2. The tapered transition between the differing diameters is supported by ribs 14. Areas between the ribs 14 provider a flow path for the fluid to pass through. The internal profile of the centralization dart is tapered and narrows down to the internal diameter.

The magnet assembly 700 consists of lengths of magnetic bars 15 supported at either end by support rings 16. The assembly is preferably made from stainless steel or a steel alloy that has good mechanical properties and can withstand temperature and chemical resistance. The bore of the support rings 16 is sized larger than the outer diameter of the screen/mesh 2. The outer edges of the support rings 16 are tapered to encourage the fluid to flow around the rings 16 and into the annulus between the tubular body and outer edge of the screen/mesh 2. The magnetic bars 15 are mounted equi-spaced around the circumference of the support rings 16. The magnetic bars 15 can be welded onto the support rings 16 or by any other permanent means. Optionally, the number of magnetic bars can be changed depending on the amount of debris to be recovered and is selected on the amount of debris to be recovered, respectively. Optionally, the number of magnetic bars will not create a significant pressure drop across the tool.

The magnetic bars 15 consist of hollow section which houses rare earth magnetic discs. In the preferred embodiment, rectangular hollow section is used. It is preferred that the discs are arranged inside the hollow section alternating every magnet with a spacer. Optionally the spacer can be made from steel. Either end of the magnetic bars 15 are capped to encapsulate the magnetic discs. The strength of the magnet discs are to be strong enough to capture and hold the debris without being washed off by the velocity of the flawing fluid. The magnetic bars 15 are to be strong enough to magnetize the screen/mesh 2 to further increase the capture ability.

Within the dart support member 13, is sized to house a rupture disc 7 and/or bristle rings 6. The internal shoulder 17 of the dart support member 13 and shoulder of the mesh/screen secures the rupture disc 7 and/or bristle rings 6 and prevents from movement while in operation. The two components can work together or independently to restrict the flow of drilling fluid or similar through the bore of the mud filter tool. This restriction encourages the majority of the drilling fluid to bypass the inner string bore and instead pass through the annular side of the screen/mesh allowing for maximum debris retention as well as ensuring that the majority of the drilling fluid has passed the magnets & is clean of any suspended metal/magnetic particles. If the rupture disc 7 and bristle ring 6 is used together, a spacer ring 22 is required to maintain the gap between the two components. This allows the bristles on the brush ring 6 enough adage to deflect without impeding the membrane of the rupture disc 7.

The rupture disc 7 can be manufactured out of a number of materials. In the preferred embodiment, the rupture disc 7 is manufactured from hydrogenated acrylonitrile butadiene rubber (HNBR). The rubber membrane 18 is bonded to a metal ring 19. The membrane of the rupture disc designed to be non-fragmented when burst. This aids in preventing further debris from entering the drill string. The rupture disc 7 is primarily designed to be activated by a change in pressure however, applying a load against the membrane 18 will also burst the disc and provide a passage through the tool. The bore of the rupture disc 7 is sized the same as the bore of the screen/mesh as to create a constant flow area. Optionally the bonded HNBR on the metal ring can create a seal against the bore of the dart support member. This further helps prevent debris from entering the bore of the tool.

The bristle ring 6 can be positioned in front of the rupture disc 7 to prevent damage b the flowing drilling fluid. In the preferred embodiment, the individual bristles 20 are made from steel/stainless steel or steel alloy. This provides the resilience as well as durability to withstand and capture debris present in the drilling fluid. Optionally, the individual bristles 20 can also be made from plastic or a compound of plastic. Optionally, the bristle ring 6 can be stacked together to provide the preferred resilience with more bristle strips providing a greater resilience. Optionally, the bristle ring 6 can be used independently of the rupture disc 7 to prevent fluid flow through the mud filter tool. Optionally, the brush strip 6 can be made by forming a metal ring 21, with the same diameter as the internal diameter of the dart support member, around individual bristles 20 wrapped around a steel wire wherein the length of individual bristle is twice as long as is the required length so to fully enclose the ring.

Those of skill in the art will appreciate the above-described embodiments are merely exemplary of the present invention, and that various modifications and improvements may be made thereto without departing from the scope of the invention.

While the foregoing is directed to embodiments of the present invention, other and further embodiments of the invention may be devised without departing from the basic scope thereof, and the scope thereof is determined by the claims that follow.

REFERENCE NUMERALS

1 metal tubular body
2 cylindrical screen/mesh
3 magnet
4 shovel support member
5 centralizer support member
6 bristle ring
7 rupture disc
9 opening
**9*a*** hole
**9*b*** longitudinally-extending slot
10 thread(ed)
11 conical funnel support member
12 internal bore
13 dart support member
14 rib
15 magnetic bar
16 support rind
17 internal shoulder
18 rubber membrane
19 metal ring
20 individual bristle

21 metal ring
22 spacer ring
100 mud filter assembly
200 wellbore
300 drill string
400 drill string with elongate members above the mud filter assembly
500 drill string with elongate members below the mud filter assembly
600 sub-assembly
700 debris-laden drilling fluid
800 drilling mud below the drill string

The invention claimed is:

1. A wellbore tool usable to capture and retain debris from drilling fluid entering a drill string (300) and prevent debris-laden fluid from entering sensitive BHA components, comprising:

a tubular body with selectively connectable threaded connections to the drill string (300) and/or workstring and housing a sub-assembly (600), comprising;

a steel tubular screen and/or mesh (2) with an outer diameter smaller than an inside diameter of the tubular body supported within a bore of the tubular body by a dart support member (13) and a tapered conical support member, allowing for an annular collection gap surrounded by a set of magnetic bars (15), a bristle ring (6) or a set of bristle rings mounted in a bore of the steel tubular screen and/or mesh (2) used independently or in conjunction with a rupture disc, (7) which prevents fluid from entering a bore of the wellbore tool and diverts it around towards the annular collection gap between the inside diameter of the tubular body and outer diameter of the steel tubular screen and/or mesh (2), and wherein the rupture disc (7) can be burst by a change in pressure or by applying a load against a membrane of the rupture disc.

2. The wellbore tool as claimed in claim 1, wherein the bore of the wellbore tool is further configured to direct away drilling fluid in the drill string (300) from the bore of the wellbore tool and into the annular collection gap between the steel tubular screen and/or mesh (2) and the bore of the tubular body.

3. The wellbore tool as claimed in claim 1, wherein the steel tubular screen and/or mesh is further configured to retained large debris in the annular collection gap and not allow the large debris in the drilling fluid to pass through the steel tubular screen and/or mesh.

4. The wellbore tool as claimed in claim 1, wherein the set of magnetic bars are further configured to capture any metallic or ferrous debris.

5. The wellbore tool as claimed in claim 1, wherein the steel tubular screen and/or mesh (2) has a plurality of openings (9) in the form of holes (9*a*) or longitudinally extended slots (9*b*) or a combination of both.

6. The wellbore tool as claimed in claim 1, wherein the steel tubular screen and/or mesh is further configured to allow drilling fluid to pass through and into the bore of the wellbore tool free from debris.

7. The wellbore tool as claimed in claim 1, wherein the bristle ring (6) or sets of bristle rings and/or rupture disc (7) are configured to divert the fluid away from the bore of the wellbore tool and into the annular collection gap.

8. The wellbore tool as claimed in claim 1, wherein the rupture disc (7) is configured to burst by either a change in pressure or by applying a load against the membrane of the rupture disc.

9. The wellbore tool as claimed in claim 1, wherein the pressure can be changed by varying a thickness of the membrane of the rupture disc.

10. The wellbore tool as claimed in claim 1, wherein individual bristles of the bristle ring (6) are made from a resilient material which is able to withstand high flow rates and debris tolerant to divert the fluid flow, prevent debris from entering the bore of the wellbore tool and, if required, protect the rupture disc (7).

11. The wellbore tool as claimed in claim 10, wherein material of the individual bristles is a polymer or steel.

12. The wellbore tool as claimed in claim 1, further comprising a wireline tool, and wherein the bore of the wellbore tool is configured to be large enough to allow the wireline tool to be passed through.

13. The wellbore tool as claimed in claim 1, wherein the set of magnetic bars (15) are permanent magnets (3) with high strength and temperature resistance.

14. The wellbore tool as claimed in claim 1, wherein the set of magnetic bars are further configured to be arranged equi-spaced radially around the steel tubular screen and/or mesh (2) to maximize flow and minimize pressure drop across the wellbore tool.

15. The wellbore tool as claimed in claim 1, wherein a quantity of the set of magnetic bars (15) is configured to be changed and/or is selected depending on an amount of ferrous required to be captured.

* * * * *